United States Patent [19]

Korteweg

[11] 4,384,526

[45] May 24, 1983

[54] CYLINDER SCREEN PRINTING MACHINE WITH MEANS FOR CONTROLLING THE MOVEMENT OF THE PAPER HOLDING CLIPS

[75] Inventor: Adriaan M. Korteweg, Ede, Netherlands

[73] Assignee: Cilinderscreen Holland B.V., Netherlands

[21] Appl. No.: 247,175

[22] Filed: Mar. 24, 1981

[51] Int. Cl.[3] ..... B41F 1/30

[52] U.S. Cl. ..... 101/409

[58] Field of Search ..... 101/408, 409, 410

[56] References Cited

U.S. PATENT DOCUMENTS

| | | | |
|---|---|---|---|
| 2,699,941 | 1/1955 | Huck et al. | 101/409 |
| 2,865,289 | 12/1958 | Fowlie et al. | 101/409 |
| 3,120,180 | 2/1964 | Black et al. | 101/409 |
| 3,637,202 | 1/1972 | Mowry et al. | 101/409 |
| 3,937,142 | 2/1976 | Cerny et al. | 101/409 |

FOREIGN PATENT DOCUMENTS 665816 7/1963 United Kingdom ..... 101/124

*Primary Examiner*—Richard J. Apley
*Assistant Examiner*—David J. Isabella
*Attorney, Agent, or Firm*—Leydig, Voit, Osann, Mayer and Holt, Ltd.

[57] ABSTRACT

A paper holding mechanism on the cylinder of a cylinder screen printing machine said paper holding mechanism being formed by clips which are controlled by a stationary cam by means of which the clips can be swung in and out of the operative position as well as by a rotating cam controlling the opening and closing of the clips which cam rotates with a speed such that during a complete working stroke and return stroke said cam has made two revolutions, said rotating cam having two opposite cam surfaces by means of which the clips can be moved against the cylinder surface so that also during part of the return stroke the clips do not extend outside of the cylinder surface.

1 Claim, 4 Drawing Figures

CYLINDER SCREEN PRINTING MACHINE WITH MEANS FOR CONTROLLING THE MOVEMENT OF THE PAPER HOLDING CLIPS

The present invention relates to a cylinder screen printing machine comprising a cylinder with means to rotate said cylinder according to a reciprocating movement, said cylinder having a plurality of paper clips arranged in a row parallel to the axis of the cylinder and protruding through openings in the cylinder wall. The clips have the shape of an inverted L and are mounted upon a beam rotatably supported within the cylinder and movable by cam means to move the clips between an open paper receiving position and a closed paper holding position in which the short legs of the L-shaped clips are pressed against the outer surface of the cylinder. Printing machines of this type are well known. In said machines the opening and closing of the clips for holding the paper is accomplished by cams which close the clips suddenly.

This not only has the disadvantage to produce undesirable noise but also leads to overloading of the clips and accordingly breakage.

The main purpose of the invention is to provide a mechanism for controlling the movements of the clips such that they move gradually, avoiding overloading and breakage of the clips and reducing noise.

According to the invention this purpose is achieved in that the said beam is rotatably supported in the outer ends of at least two levers having their other ends rotatably supported within the cylinder, of which levers one has an extension which by means of a spring is held in engagement with a rotatable first cam controlling the movement of said levers and thus of the opening and closing of the clips, the said beam itself having a lever which by means of a spring is held in contact with a second stationary cam by means of which the clips can be tilted inwardly with respect to the cylinder surface and outwardly respectively, the said first cam being continuously driven in the direction of the working stroke of the cylinder with a speed such that during one complete working and return stroke of the cylinder said first cam makes two revolutions. The said first driven cam is of a shape such that at the dead point of the movement of the cylinder between the return and the next working stroke the beam with clips is moved inwardly, during the working stroke the beam is moved outwardly, and during the return stroke the beam is moved inwardly when the clips pass through the top of the cylinder and is moved outwardly before the end of the return stroke. Simultaneously the second stationary cam at the dead point holds the clips in the outwardly swung position, returns them inwardly during the working stroke and moves them outwardly again during and before the end of the return stroke.

With the mechanism according to the invention the clips are moved such that during the return stroke and passing through the top of the cylinder they are held in a withdrawn position so that they cannot touch the screen. At the dead point of movement between the return stroke and next working stroke the stationary cam has insured that the clips already are in the outwardly swung position and accordingly open. The rotating cam which controls the inward and outward movement of the clip carrying beam and which rotates in the same direction as the working stroke but with higher speed then insures a gentle closing movement so that noise and overloading are prevented. After a certain part of the working stroke substantially at the same time that the clips are tilted inwardly the clips are opened to release the paper which at that moment is held against the cylinder wall by suction. During the return stroke the rotating cam provides for the inward movement and about at the same moment upon the stationary cam tilts the clips outwardly to make sure that, as stated above the clips cannot touch the screen but are opened again before the end of said return stroke. This combination of movements together with the gentle closing is only possible by using in combination the stationary cam and the rotating cam and splitting up the movements such that the stationary cam controls the swinging of the clips in and out of their operative position whilst the rotating cam takes care for the opening and closing at the proper moments.

The invention now will be further elucidated with reference to the drawings.

Figure 1:
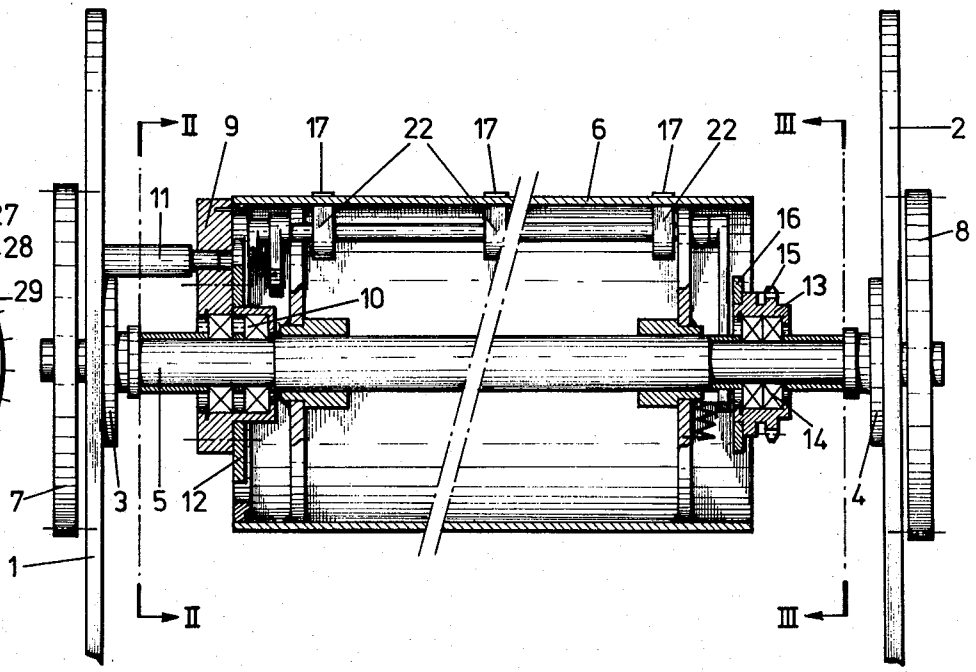
FIG. 1 is a horizontal section through part of a cylinder screen printing machine at the level of the cylinder axis.

FIG. 1 shows frame members 1 and 2 with bearing houses 3 and 4 in which has been supported the shaft 5 of the cylinder 6. Outside the frame members 1 and 2 gear wheels 7 and 8 are mounted upon the shaft 5 which gear wheels cooperate with racks upon the screen frame (not shown) as disclosed in copending patent application Ser. No. 247,174, entitled, "Screen Printing Machine".

On the left side of the cylinder shown in FIG. 1 a stationary part 9 is mounted upon the shaft 5 through the intermediance of bearings 10 and held against rotation by a pin 11 fixed to the side frame member 1. Said member 9 carries a cam 12 the shape of which is clearly shown in FIG. 2.

Figure 3:
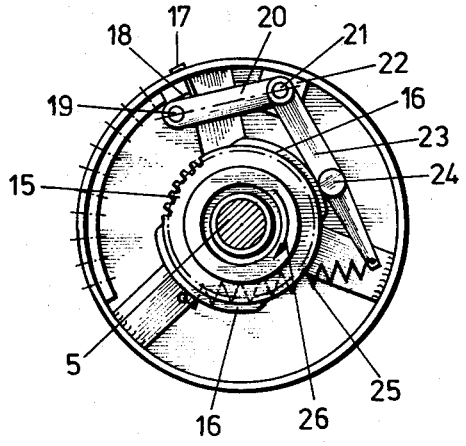
FIG. 3 is a section according to the line III—III of FIG. 1.

On the right side of the shaft 5 a bushing 13 has been provided supported upon said shaft by bearings 14 and carrying a sprocket wheel 15 as well as a cam 16 the shape of which is shown in FIG. 3.

The clips for holding paper upon the outer surface of the cylinder 6 are indicated with the reference 17. They are mounted upon a beam 18 and rotatably supported at 19 in levers 20 which are rotatably supported at 21 in brackets 22 secured to the inner wall of the cylinder 6.

The right hand lever 20 shown in FIG. 3 has an extension 23 held against the cam 16 with a roller 24 by means of the spring 25.

In the position shown in FIG. 3 the clips 17 are held in the closed position. Said cams rotate in the direction of the arrow 26 by a chain drive engaging the sprocket wheel 15.

Figure 4:
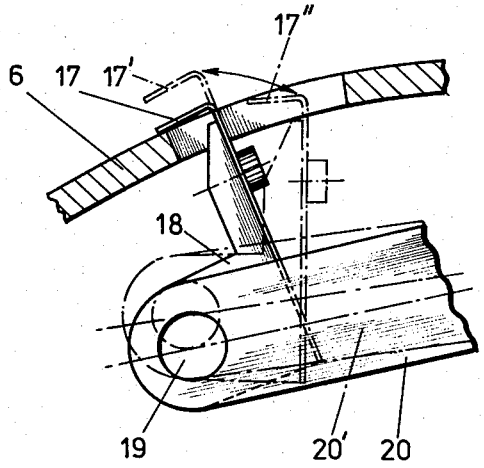
FIG. 4 shows a detail at larger scale at the location of a clip.

FIGS. 3 and 4 make clear that when the roller 24 leaves the cam surface 16 and moves more inwardly the lever 20 swings outwardly which opens the clips 17.

Figure 2:
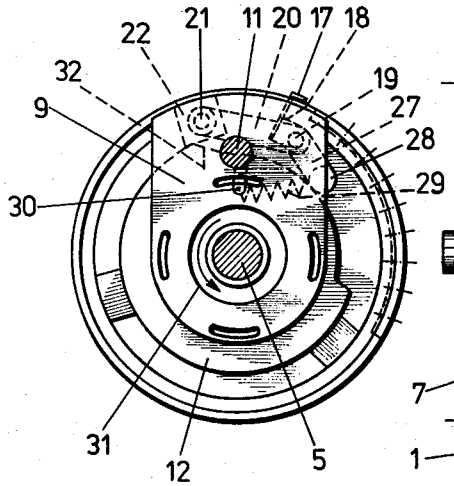
FIG. 2 is a section according to the line II—II of FIG. 1.

As shown in FIG. 2 beam 18 has a lever 27 which by means of a roller 28 engages the surface of cam 12. This lever 27 by means of spring 29 is held against said cam 12 said spring with its upper end being connected to a leg 30 which is integral with the lever 20.

From FIG. 2 it will be clear that when the cylinder moves counter clockwise in said figure according to the arrow which indicates also the direction of rotation of the working stroke of the cylinder, then the roller 28 of lever 27 will climb up the surface 32 of the cam 12 with the result that the beam 18 with the clips 17 is tilted to the left. During the return stroke the reverse takes place.

The working stroke is almost 180°.

FIG. 4 shows in full lines the closed position with the clips with the short leg of the L-shaped clip in engagement with the surface of the cylinder 6. When lever 20 is moved outwardly in the position shown with interrupted lines at 20' then the clip moves into the opened position indicated with 17'.

When lever 27 moves up the surface 32 of the stationary cam 12 the beam 18 is tilted to the right in FIG. 4 which means that the clips move into the position indicated in FIG. 4 with 17''.

In FIG. 2 the working stroke has its starting position as shown. In this position the clips with their beam are held in the position shown in FIG. 4 with full lines. During the working stroke which in FIG. 2 is a rotation counter clockwise the clips are tilted.

FIG. 3 also shows the starting position of the working stroke. In said position the clips are held in the closed position. During the rotation clockwise in FIG. 3 which is the rotation of the working stroke, cam 16 soon will allow lever 23 to move inwardly and accordingly lever 22 move outwardly into the position indicated with 17' in FIG. 4. This takes place almost at the same moment that the beam 18 is tilted with the clips inwardly so that the position shown in FIG. 4 with 17' is obtained.

During the return stroke cam 12 only reverses the tilting of the beam 18 with clips 17. The cams 16, however, take care that during the return stroke lever 20 is moved inwardly by the lower cam 16 of FIG. 3 so that when the clips 17 pass through the top they are prevented from contact with the screen. Shortly thereafter said cam 16 releases levers 23 and 20 so that the clips 17 are opened and brought in the position 17' in FIG. 4 before the return stroke is completed.

I claim:

1. A cylinder screen printing machine comprising a cylinder with means to rotate said cylinder according to a reciprocating movement, said cylinder having:

a plurality of paper clips arranged according to a row parallel to the axis of the cylinder and protruding through openings in the cylinder wall, said clips having the shape of an inverted L, means for movably mounting said clips including a beam rotatably supported within the cylinder and moveable radially inwardly and outwardly, cam means including a rotatable first cam for moving said beam radially and a stationary second cam for rotating said beam and tilting said clips to move said clips between an open paper receiving position and a closed paper holding position in which the short legs of the L-shaped clips are pressed against the outer surface of the cylinder, means for supporting said beam in said cylinder incuding at least two levers, said levers having one of their ends rotatably supported within said cylinder and their other ends rotatably supporting said beam, one of said levers engaging said rotatable first cam for moving said beam and clips radially upon relative movement between said first cam and said other ends of said levers upon rotation of said first cam, said beam having a lever engaging said stationary second cam for rotating said beam and tilting said clips radially inwardly and outwardly upon relative movement between said lever and said stationary second cam upon rotation of said cylinder, said first cam being continuously rotated in the direction of the working stroke of said cylinder with a speed such that during one complete working and return stroke of said cylinder said first cam makes two revolutions, said first cam being of a shape such that at a dead point of the movement of said cylinder between return and next working stroke said beam and clips are moved radially inwardly, during the working stroke said clips are moved radially outwardly and during the return stroke said clips are moved radially inwardly when said clips pass through the top of the cylinder and are moved radially outwardly before the end of the return stroke, while simultaneously said stationary second cam at the said dead point holds said clips in the outward position, returns them radially inwardly during the working stroke and moves them radially outwardly again during and before the end of the return stroke.

* * * * *